US006919518B2

(12) United States Patent
Rademacher et al.

(10) Patent No.: US 6,919,518 B2
(45) Date of Patent: Jul. 19, 2005

(54) PHASE FLUX BARRIERS FOR TRANSFER SWITCH

(75) Inventors: Loren L. Rademacher, Andover, MN (US); Larry H. Smith, Coon Rapids, MN (US); Joseph T. Miller, Ramsey, MN (US)

(73) Assignee: Onan Corporation, Minneapolis, MN (US)

( * ) Notice: Subject to any disclaimer, the term of this patent is extended or adjusted under 35 U.S.C. 154(b) by 118 days.

(21) Appl. No.: 10/078,651

(22) Filed: Feb. 19, 2002

(65) Prior Publication Data

US 2003/0155330 A1 Aug. 21, 2003

(51) Int. Cl.[7] ..... H01H 9/54

(52) U.S. Cl. ..... 200/1 R; 200/401; 200/428; 200/50.32

(58) Field of Search ..... 200/1 R, 1 V, 200/401, 416, 428, 50.32, 574

(56) References Cited

U.S. PATENT DOCUMENTS

| | | | | |
|---|---|---|---|---|
| 4,218,596 A | | 8/1980 | Clausing | 200/144 R |
| 4,689,716 A | | 8/1987 | Cooper et al. | 361/331 |
| 4,791,530 A | | 12/1988 | Kalvaitis et al. | 361/331 |
| 4,849,590 A | * | 7/1989 | Becker et al. | 200/147 R |
| 4,864,466 A | | 9/1989 | Gasparetto | 361/335 |
| 5,025,236 A | | 6/1991 | Miura et al. | 335/46 |
| 5,181,158 A | | 1/1993 | Goe, Jr. et al. | 361/335 |
| 5,194,840 A | | 3/1993 | Frutuoso et al. | 335/202 |
| 5,225,782 A | * | 7/1993 | Laskaris et al. | 324/318 |
| 5,296,827 A | | 3/1994 | DiMarco et al. | 335/16 |
| 5,483,416 A | | 1/1996 | Goe, Jr. | 361/600 |
| 5,894,259 A | | 4/1999 | Kolberg et al. | 337/333 |
| 5,910,757 A | | 6/1999 | Broghammer et al. | 335/9 |
| 5,923,514 A | | 7/1999 | Scott et al. | 361/93 |

* cited by examiner

*Primary Examiner*—K. Richard Lee
(74) *Attorney, Agent, or Firm*—Schwegman, Lundberg, Woessner & Kluth, P.A.

(57) ABSTRACT

A transfer switch that includes output contacts, primary input contacts, secondary input contacts and a switch stack. The switch stack alternately connects the output contacts to the primary input contacts and the secondary input contacts via at least one conductive path. The transfer switch further includes at least one flux barrier that is at least partially positioned near the conductive path to minimize magnetic interaction with the conductive path as current travels through the switch stack.

14 Claims, 5 Drawing Sheets

PHASE FLUX BARRIERS FOR TRANSFER SWITCH

FIELD OF THE INVENTION

The present invention relates to a transfer switch, and in particular to a transfer switch that provides a flux barrier between conductive paths that pass through the transfer switch.

BACKGROUND

A transfer switch is used to switch the source of electric power from a primary source, such as a utility, to a secondary source, such as a generator. Transferring power from the primary source to the secondary source is necessary when the utility experiences a blackout. The transfer switch is also used to switch the power source back to normal utility power when the power outage is over.

A typical transfer switch is composed of an actuating mechanism and a switch stack. The actuating mechanism provides energy to the switch stack to maneuver movable contacts relative to stationary power input contacts. The actuating mechanism operates by storing energy in powerful springs until a control directs the actuating mechanism to release energy from the springs. The released energy rotates a crossbar that runs through the switch stack. There are cams mounted on the crossbar that ride against and drive the movable contacts within the switch stack.

The switch stack is composed of adjacent cassettes. Each cassette, or group of cassettes, carries one-phase of current and includes at least one of the cams that are mounted on the crossbar. The cams within each cassette maneuver at least one movable contact relative to different sets of stationary contacts. The movable contacts engage one set of stationary contacts when power is supplied by the primary source and engage another set of contacts when power is supplied from the secondary source.

Each cassette, or group of cassettes, typically includes a conductive path that conducts one phase of the current through the transfer switch. As the current travels along the path, the conductors along the path generate electromagnetic forces that compress the moving contacts against the stationary contacts. This electromagnetic force counteracts a blow-off force that is generated at the interface between the contacts when there is a current surge.

The individual phases in a three-phase current are not in phase with one another. Therefore, the electromagnetic fields produced by each phase at least partially oppose the fields generated by the other phases. Since the cassettes within a switch stack are typically positioned in close proximity to one another, there are unwanted magnetic interactions between the conductors that reduce the beneficial compressive force that could otherwise be generated by each of the conductors. These magnetic interactions are especially problematic during a current surge, such as current surges generated by short circuits.

The contacts and current paths in transfer switches with high short-circuit withstand capability are typically more massive. The larger size of the contacts and current paths generate even larger magnetic fields such that the magnetic interaction between the current phases is even more problematic in such devices.

SUMMARY OF THE INVENTION

The present invention relates to a transfer switch that minimizes the magnetic interaction between each conductive path in the transfer switch. Since the effect of magnetic interactions between the current paths is reduced, or even more preferably eliminated, the conductors within the transfer switch are able to compress the moving contacts against stationary contacts according to their maximum capacity. Reducing the effect of magnetic interactions between current paths is especially effective when the current paths are isolated in transfer switches having high current withstand and closing capability.

The transfer switch includes output contacts, primary input contacts, secondary input contacts and a switch stack. The switch stack alternately connects the output contacts to the primary input contacts and the secondary input contacts via at least one conductive path. The transfer switch further includes at least one flux barrier that is at least partially positioned near the conductive path to minimize magnetic interaction with the conductive path as current travels through the switch stack.

When the transfer switch includes more than one conductive path, a flux barrier is preferably positioned between each pair of conductive paths. The flux barrier allows the conductor geometry that forms the individual conductive paths within the cassettes to generate electromagnetic forces with minimal interference from adjacent conductive paths that help hold the contacts closed during a short circuit.

The present invention also relates to a method of alternating the supply of power to an electric load. The method includes switching contacts within a transfer switch to alternately engage the switching contacts with the primary input contacts that are coupled to a primary power source and secondary input contacts that are coupled to a secondary power source. The method further includes minimizing magnetic interaction between conductive paths in the transfer switch as current travels through the transfer switch.

DETAILED DESCRIPTION

Figure 1:
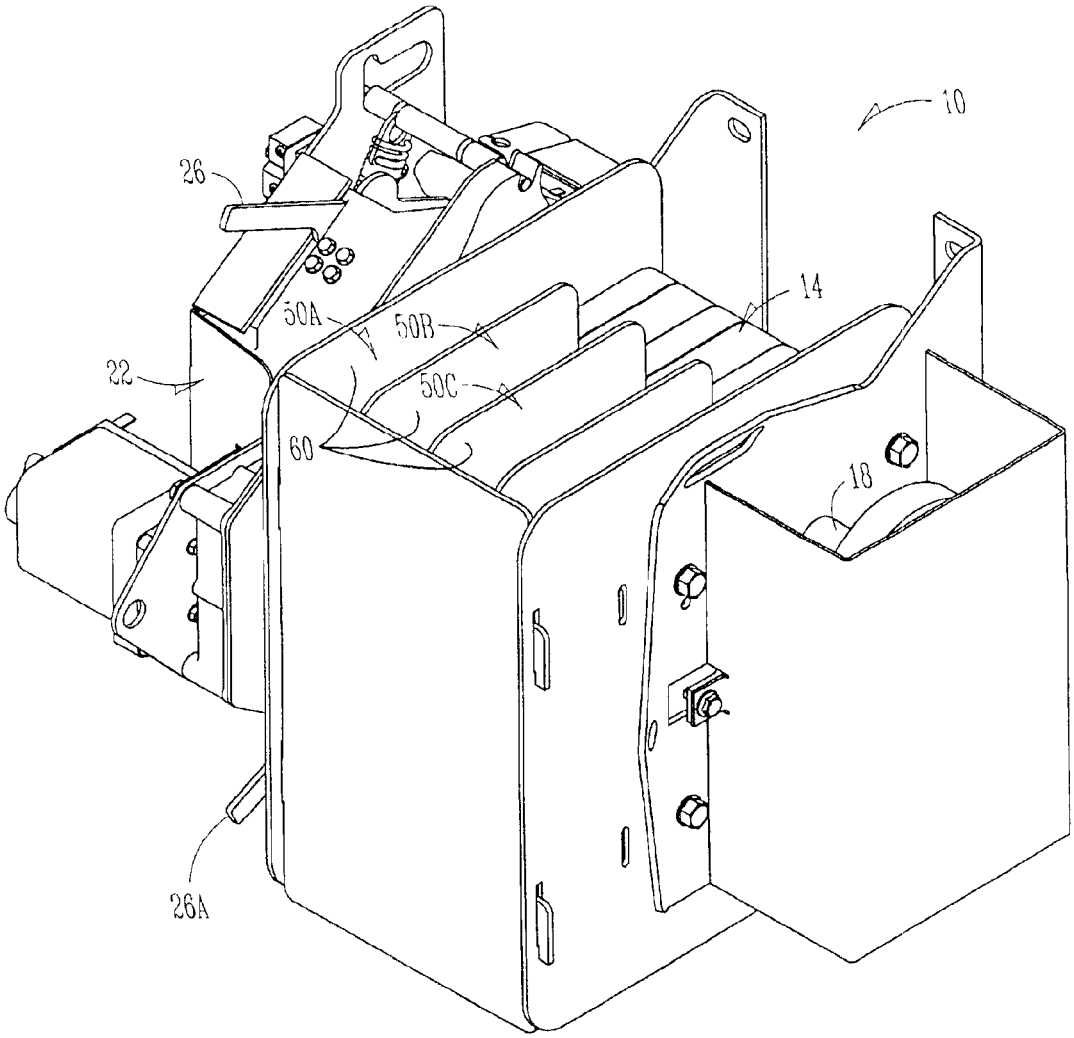
FIG. 1 is a perspective view illustrating a transfer switch of the present invention.
Figure 2:
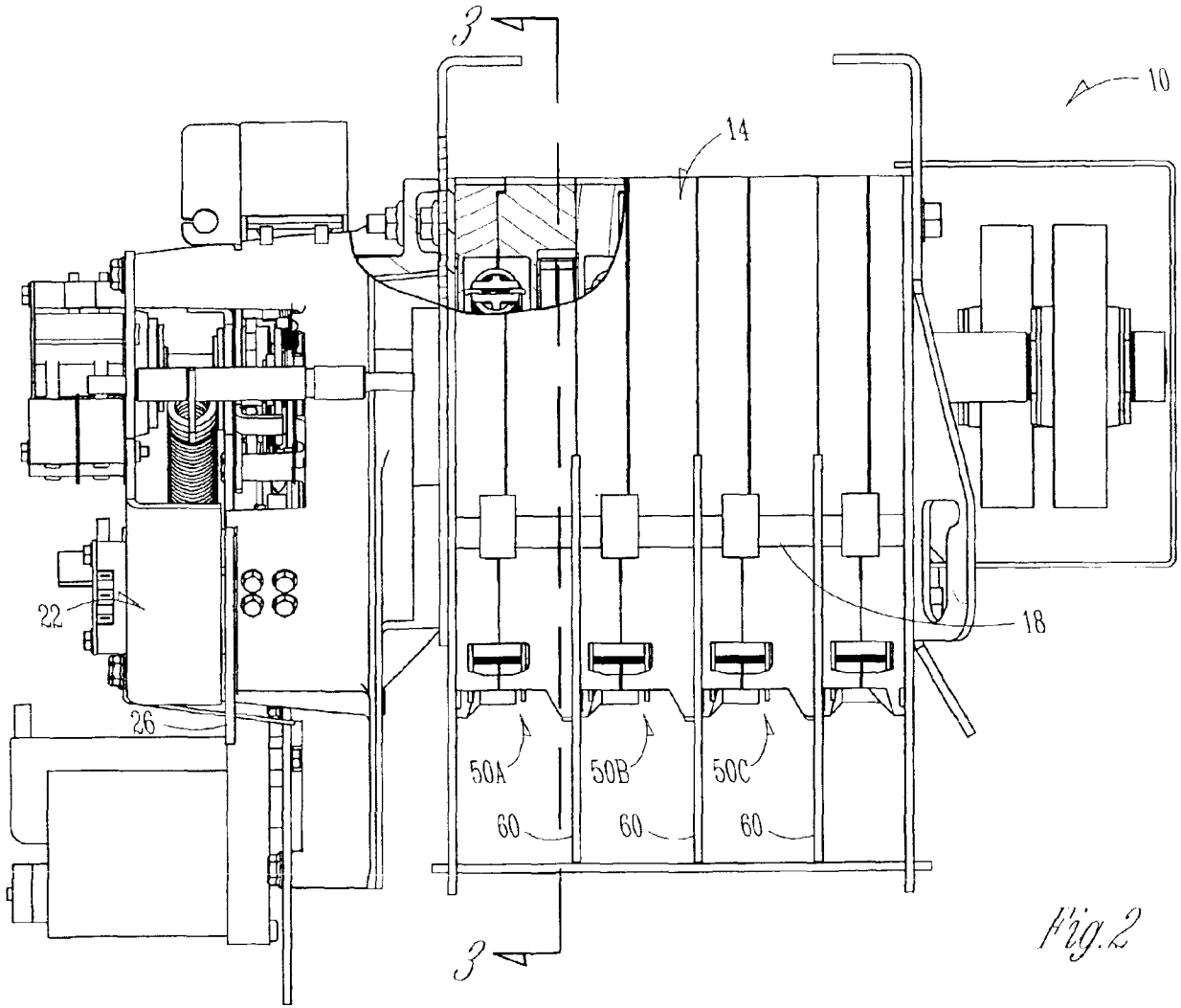
FIG. 2 is a top view of the transfer switch shown in FIG. 1.

In the following detailed description, reference is made to the accompanying drawings which show by way of illustration specific embodiments in which the invention may be practiced. These embodiments are described in sufficient detail to enable those skilled in the art to practice the invention, and it is to be understood that other embodiments may be utilized and structural changes made without departing from the scope of the present invention. Therefore, the following detailed description is not to be taken in a limiting sense, and the scope of the present invention is defined by the appended claims and their equivalents.

FIGS. 1–4 illustrate an embodiment of an electric transfer switch 10 that encompasses the present invention. The transfer switch 10 includes a switch stack 14 and a pair of crossbars 18, 19 that extend through the switch stack 14. Each of the crossbars 18, 19 is connected to an actuating mechanism 22 that rotates the crossbars 18, 19 about their respective longitudinal axes. It should be noted that the actuating mechanism 22 can be operated manually using handles 26, 26A, or automatically using other types of devices.

Figure 3:
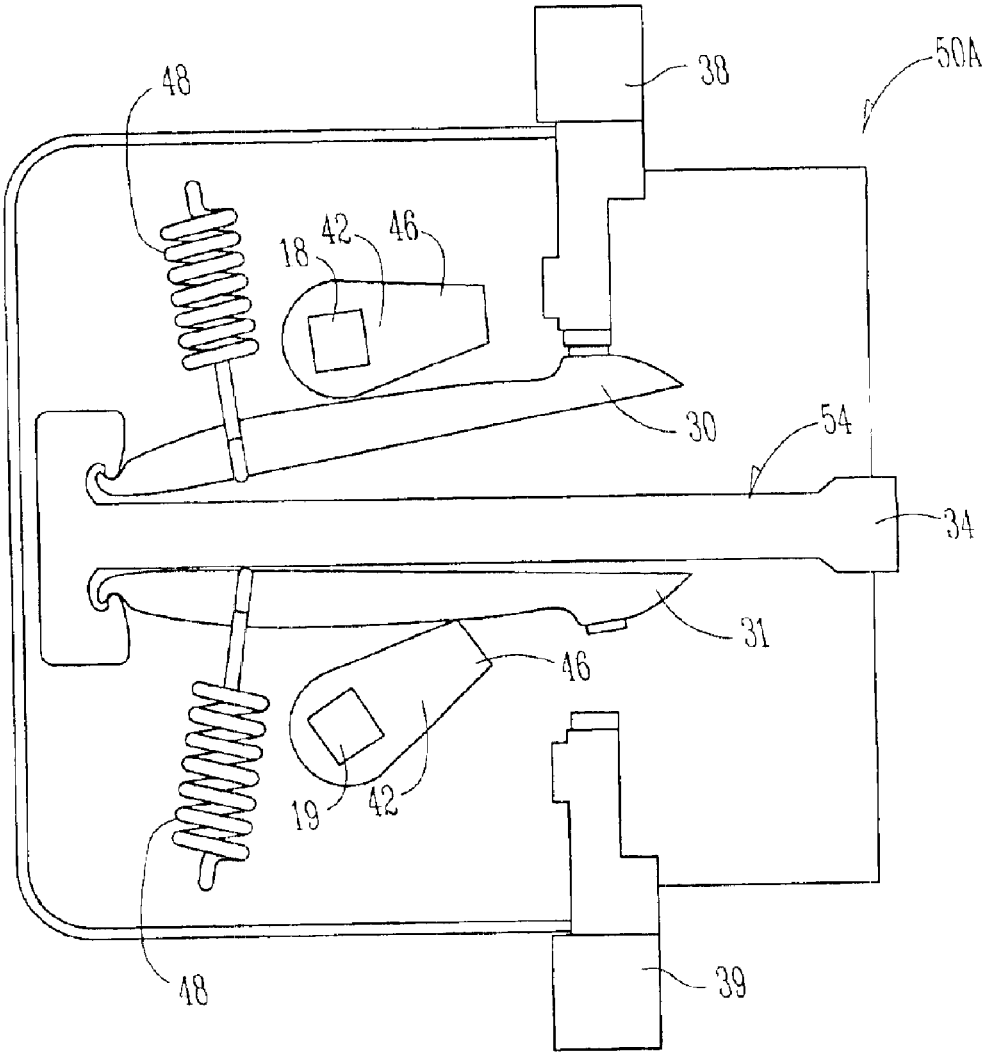
FIG. 3 is a schematic cross-sectional view of the transfer switch shown in FIG. 2 taken along line 3—3 with the transfer switch in position to supply power from a primary power source.
Figure 4:
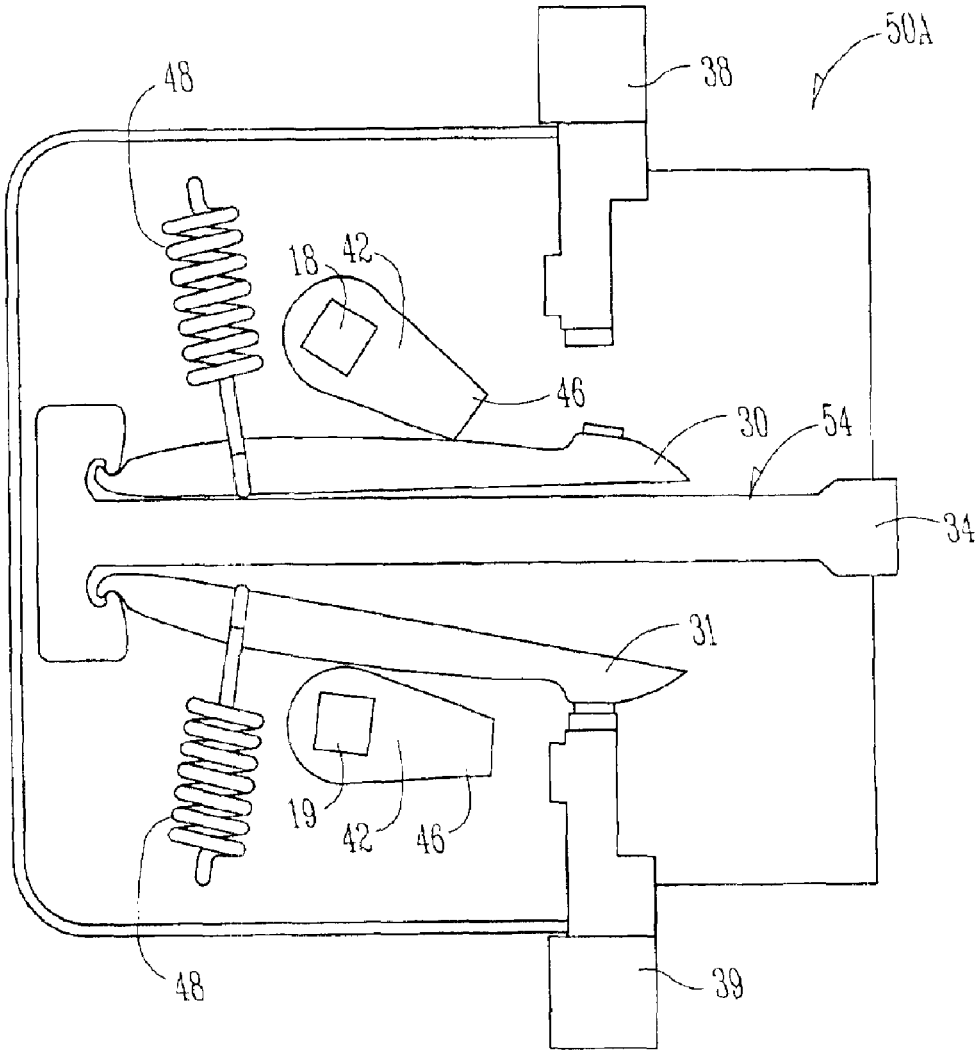
FIG. 4 is a schematic cross-sectional view similar to FIG. 3 with the transfer switch in position to supply power from a secondary power source.

Referring now also to FIGS. 3 and 4, one set of moveable contacts 30 is carried by one crossbar 18, and another set of movable contacts 31 is carried by the other crossbar 19. Each of the moveable contacts 30, 31 is connected to an output contact 34. In addition, each of the movable contacts 30 that are carried by crossbar 18 are adapted to be intermittently connected to a corresponding primary input contact 38, while each of the movable contacts 31 that are carried by crossbar 19 are adapted to be intermittently connected to a corresponding secondary input contact 39. Cams 42 are mounted on the crossbars 18, 19 to maneuver the movable contacts 30, 31 into, and out of, engagement with their respective stationary input contacts 38, 39.

The crossbars 18, 19 are rotated by the actuating mechanism 22 such that the cams 42 maneuver each set of movable contacts 30, 31 relative to the corresponding stationary contacts 38, 39. As the cams 42 rotate, the tips 46 on the cams 42 eventually begin to engage the movable contacts 30, 31 to force the movable contacts 30, 31 away from their respective stationary contacts 38, 39. Conversely, once the tips 46 of the cams 42 rotate in the opposite direction past the movable contacts 30, 31, a spring 48 forces each movable contact 30, 31 into engagement with their respective stationary input contact 38, 39.

FIG. 3 shows the movable contacts 30 engaged with the primary input contacts 38 when power is being supplied from a primary power source, such as a utility. As shown in FIG. 4, when there is an interruption in the primary power supply, the cams 42 on crossbar 18 rotate to disengage the movable contacts 30 from the primary input contacts 38, and the cams 42 on crossbar 19 rotate to allow the movable contacts 31 to engage the secondary input contacts 39 so that power can be supplied from a secondary power source, such as a generator. The transfer switch 10 may include the ability to control the amount of time it takes to switch from the normal main power supply to a standby emergency power supply.

The switch stack 14 is composed of, but not limited to, adjacent cassettes 50A, 50B, 50C. Each cassette 50A, 50B, 50C includes a conductive path 54 that carries one-phase of a three-phase current and also includes at least one of the cams 42 that are mounted on each crossbar 18, 19. In addition, each cassette 50A, 50B, 50C includes one moving contact from both sets of moving contacts 30, 31 such that the cams 42 appropriately maneuver individual moving contacts 30, 31 within each cassette relative to a corresponding stationary contact 38, 39. The movable contacts 30 on crossbar 18 within each cassette 50A, 50B, 50C engage the primary input contacts 38 within each cassette 50A, 50B, 50C when power is supplied by the primary source. The movable contacts 31 on crossbar 19 within each cassette 50A, 50B, 50C engage the secondary input contacts 39 when power is supplied by the secondary power source.

When a "fault" current passes through the conductive path 54 in each cassette 50A, 50B, 50C, electromagnetic repulsive forces of very high magnitude are generated between the moveable contacts 30, 31 and the stationary contacts 38, 39. These forces cause the mating contacts to blow apart from their normally closed position. As the contacts separate, there is electrical arcing that can cause the contacts to vaporize, or weld together, thereby rendering the switch inoperable.

Figure 5:
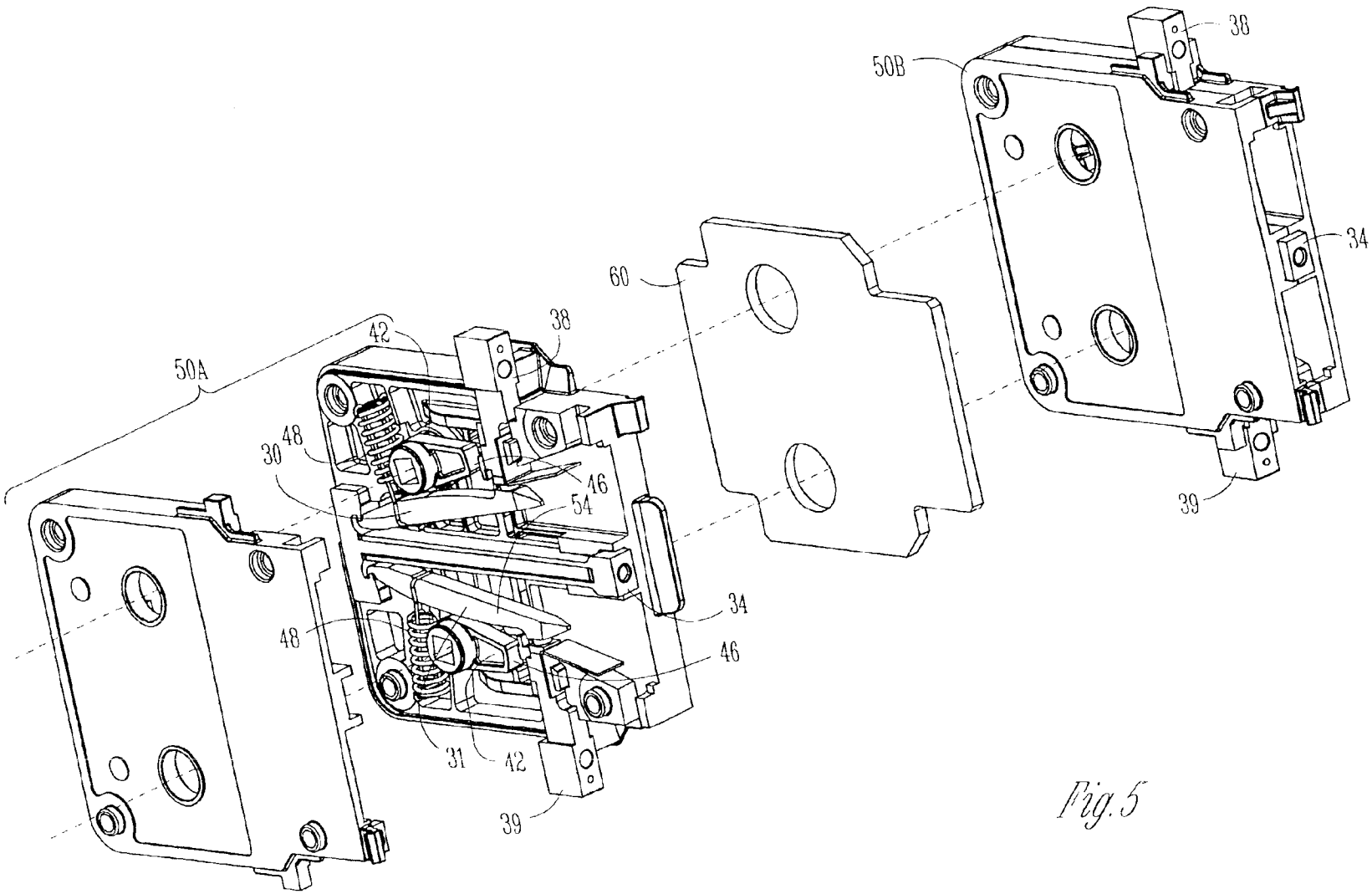
FIG. 5 is an exploded perspective view of a portion of a switch stack that is used in the transfer switch shown in FIG. 1.

One phase of the three-phase current flows through each cassette 50A, 50B, 50C in the transfer switch 10. As each phase of the current travels along the conductive path 54, the conductors along the conductive path 54 generate an electromagnetic force that compresses each of the moving contacts 30, 31 against a respective stationary contact 38, 39 depending on whether power is being supplied from the primary source or the secondary source. This electromagnetic force is beneficial because it counteracts a blow-off force that is generated at the interface of the contacts when there is a current surge. FIGS. 3–5 illustrate example conductive paths 54 for each cassette 50A, 50B, 50C.

The individual phases in a three-phase current are not in phase with one another. Therefore, the electromagnetic fields that are produced along each conductive path 54 are at least partially opposed by the fields that are generated by the other conductive paths 54. Since the cassettes 50A, 50B, 50C within the switch stack 14 are typically positioned in close proximity to one another, there are unwanted magnetic interactions between the conductive paths 54. These interactions reduce the compressive force that can be generated by the current traveling through the conductors in each conductive path 54 to keep the moving contacts 30, 31 against the respective stationary contacts 38, 39.

The transfer switch 10 of the present invention minimizes the magnetic interaction between each conductive path 54 in the transfer switch 10. The transfer switch 10 includes flux barriers 60 that are at least partially, or entirely, positioned between each of the conductive paths 54. The flux barriers 60 minimize magnetic interaction between the conductive paths 54 as each current phase travels through the cassettes 50A, 50B, 50C in the switch stack 14. Each flux barrier 60 in the transfer switch 10 is positioned between a unique pair of conductive paths 54. The flux barriers 60 are preferably, although not necessarily, planar steel sheets that are secured to individual cassettes 50A, 50B, 50C. In an alternative embodiment, the flux barriers 60 are part of an integral assembly.

Since the effect of magnetic interactions between the conductive paths 54 is reduced, or even more preferably eliminated, the conductors along the conductive paths 54 compress the movable contacts 30, 31 against stationary contacts 38, 39 according to their maximum capacity. Reducing the effect of magnetic interactions between the conductive path 54 is especially effective when the conductive paths 54 are isolated in transfer switches 10 having high current withstand and closing capability.

The present invention also relates to a method of alternating the supply of power to an electric load. The method includes switching contacts 30, 31 within a transfer switch 10 to alternately engage the switching contacts with primary input contacts 38 that are coupled to a primary power source and secondary input contacts 39 that are coupled to a secondary power source. The method further includes minimizing magnetic interaction with a conductive path 54 in the transfer switch 10 as current travels through the transfer switch 10. Minimizing magnetic interaction with the conductive path 54 may include placing a flux barrier 60 partially, or entirely, along both sides of the conductive path 54.

When the transfer switch 10 includes a plurality of conductive paths 54, the method may include minimizing magnetic interaction between the conductive paths 54 by inserting flux barriers 60 at least partially, or entirely, between each of the conductive paths 54. The flux barriers 60 between each of the conductive paths 54 preferably isolate each conductive path 54 from magnetic interaction with the other conductive paths 54. Inserting a flux barrier 60 between the conductive paths may include mounting flux barriers 60 to a switch stack 14, including mounting individual flux barriers 60 to individual cassettes 50A, 50B, 50C within the switch stack 14.

It is understood that the above description is intended to be illustrative, and not restrictive. Many other embodiments will be apparent to those of skill in the art upon reviewing the above description. The scope of the invention should, therefore, be determined with reference to the appended claims, along with the fall scope of equivalents to which such claims are entitled.

What is claimed is:

1. A transfer switch comprising:

output contacts;

primary input contacts;

secondary input contacts; and a switch stack alternately connecting the output contacts to the primary input contacts and the secondary input contacts via at least one conductive path; and a magnetic flux barrier at least partially positioned near the conductive path to minimize magnetic interaction with the conductive path as current travels through the switch stack.

2. The transfer switch of claim 1 wherein the flux barrier is a planar sheet.

3. The transfer switch of claim 1 wherein the transfer switch includes a plurality of conductive paths and the flux barrier isolates each of conductive paths from magnetic interaction with the other conductive paths.

4. The transfer switch of claim 3 wherein the switch stack includes multiple cassettes, each cassette including a conductive path.

5. The transfer switch of claim 4 wherein the flux barrier is secured to at least one of the cassettes.

6. The transfer switch of claim 4 wherein each cassette includes an output contact, a primary input contact and a secondary input contact.

7. The transfer switch of claim 4 wherein the flux barrier includes different portions that are at least partially positioned between each of the cassettes.

8. The transfer switch of claim 7 wherein the different portions of the flux barrier isolate each cassette entirely from magnetic interaction with the other cassettes.

9. The transfer switch of claim 7 wherein the different portions of the flux barrier are integral with one another.

10. A transfer switch comprising:

output contacts;

primary input contacts;

secondary input contacts; and a switch stack alternately connecting the output contacts to the primary input contacts and the secondary input contacts via at least one conductive path; and a flux barrier at least partially positioned near the conductive path to minimize magnetic interaction with the conductive path as current travels through the switch stack, wherein the flux barrier is a planar sheet made of steel.

11. A transfer switch comprising:

output contacts;

primary input contacts;

secondary input contacts;

a switch stack alternately connecting the output contacts to the primary input contacts and the secondary input contacts via a conductive path; and means for reducing magnetic interaction with the conductive path in the transfer switch.

12. The transfer switch of claim 11, wherein the means for reducing magnetic interaction with the conductive path includes a flux barrier positioned near the conductive path to minimize magnetic interaction with the conductive path.

13. The transfer switch of claim 11, wherein the transfer switch includes a plurality of conductive paths, and the flux barrier includes a plurality of portions such that each portion is positioned between a unique pair of conductive paths.

14. The transfer switch of claim 11, wherein the means for reducing magnetic interaction between the conductive paths is a planar steel sheet.

* * * * *